United States Patent [19]

Zoglman

[11] 4,384,430

[45] May 24, 1983

[54] DOCTOR BLADE SHARPENER

[75] Inventor: Joseph L. Zoglman, Santa Claus, Ind.

[73] Assignee: Zogo Industries, Inc., Dale, Ind.

[21] Appl. No.: 222,145

[22] Filed: Jan. 2, 1981

[51] Int. Cl.[3] ..... B24B 3/34

[52] U.S. Cl. ..... 51/59 R

[58] Field of Search ..... 51/59 R

[56] References Cited

U.S. PATENT DOCUMENTS

| | | | |
|---|---|---|---|
| 1,383,686 | 7/1921 | Wiezbowski | 51/59 R |
| 1,475,681 | 11/1923 | Brown | 51/59 R |
| 1,509,836 | 9/1924 | Haldeman | 51/59 R |
| 1,652,469 | 12/1927 | Dodge | 51/59 R |
| 2,630,721 | 3/1953 | McEwan | 51/59 R |

*Primary Examiner*—Harold D. Whitehead

*Attorney, Agent, or Firm*—Warren D. Flackbert

[57] ABSTRACT

A doctor blade sharpener characterized as automatic equipment utilizing a honing member which travels along the length of a doctor blade secured for sharpening purposes, where movement of the honing member is selectively reversed direction-wise through an air powered control arrangement. A primary feature afforded by the invention is in avoiding injury to the person during the sharpening procedure, in that no direct hand contact is involved for sharpening once the doctor blade has been positioned on the apparatus.

2 Claims, 3 Drawing Figures

DOCTOR BLADE SHARPENER

As is known, doctor blades have a widespread usage, such as, for example, in panel printing processes. In this connection, the doctor blade used in offset gravure printing serves to remove excess printing ink used in producing the decorative design and, as well, in connection with any other flowing materials in like processes.

A difficulty inherent with the use of a doctor blade is in maintaining the latter in a sharpened condition, i.e. to afford optimum excess material removal, and to thus achieve a high quality end product. Sharpening of the doctor blades is typically a hand operation, resulting, oftentimes, in bodily, i.e. hand, injury to the person involved in the sharpening procedure. In other words, in order to maintain the doctor blade at operational standards, the hand sharpening thereof is a necessity. Moreover, in addition to safety problems, it is oftentimes difficult to assure uniform sharpening of the doctor blade from end to end, noting that the latter might extend from a 7 inch to a 68 inch length.

The invention overcomes the preceding difficulties in providing a doctor blade sharpener presented as automatically functioning equipment onto which the doctor blade is secured for sharpening purposes. A honing member is caused to travel, through an air powered control arrangement, along the surface of the doctor blade, making repeated passes to accomplish sharpening action. In other words, once the unsharpened doctor blade has been positioned on the apparatus, the operator is not required to contact such and run the risk of bodily injury, in that, as stated, sharpening is achieved by the successive passing of a honing member over the blade under process.

Figure 1:
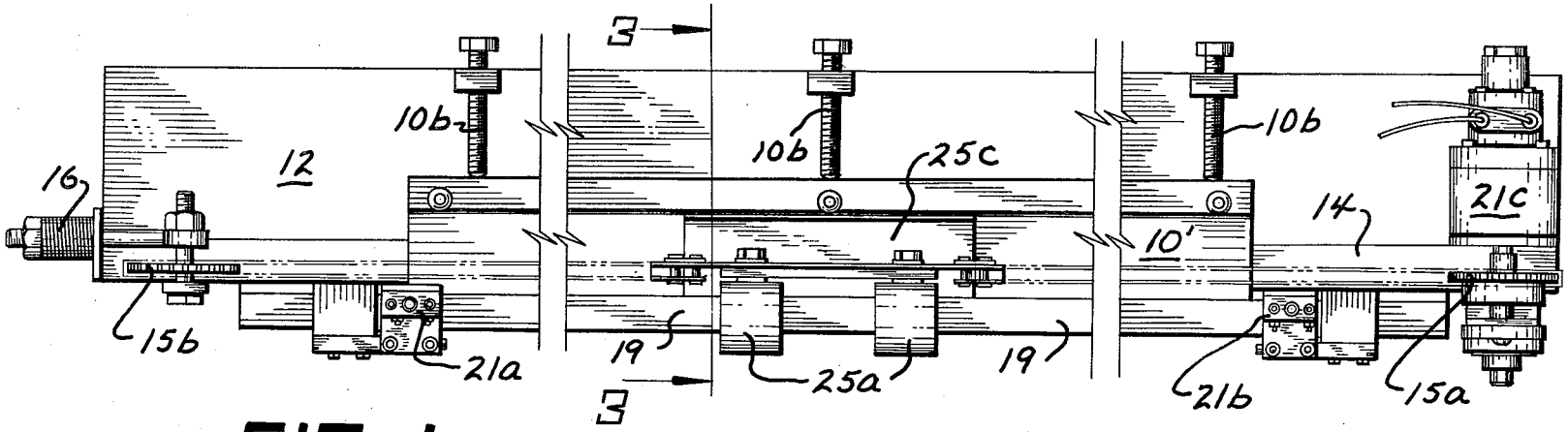
Figure 3:
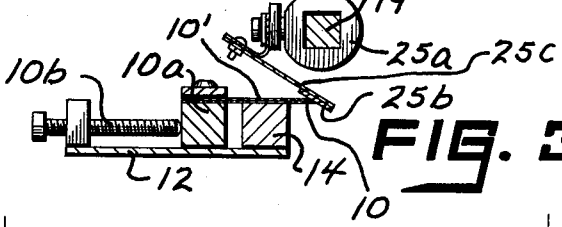
Figure 2:
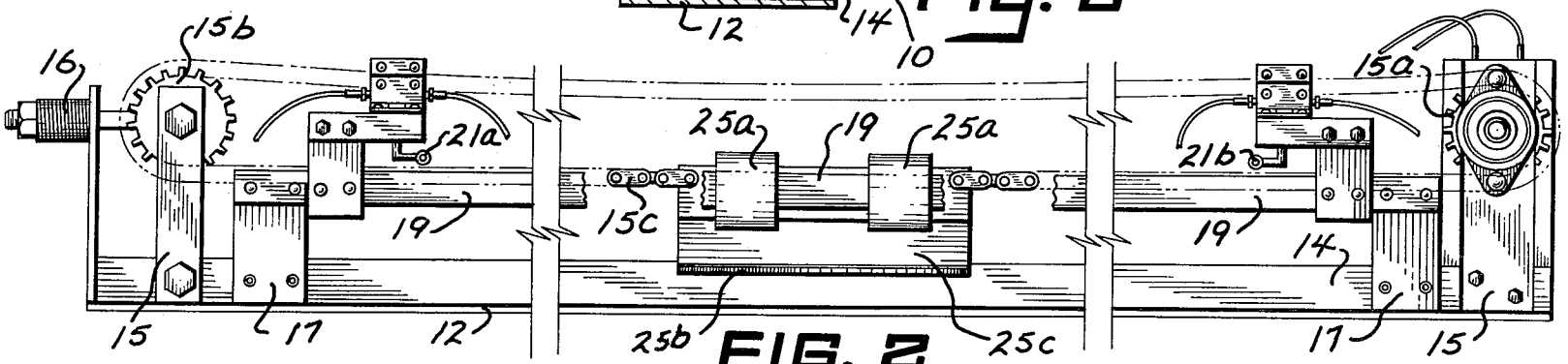

In other words, the invention not only affords uniformity in end results, but, importantly, achieves such safely and rapidly by equipment relatively simple in component number and arrangement. In any event, a better understanding of the present invention will become more apparent from the following description, taken in conjunction with the accompanying drawing, wherein FIG. 1 is a top plan view of a doctor blade sharpener in accordance with the teachings of the present invention;

FIG. 2 is a view in side elevation of the instant doctor blade sharpener, generally corresponding to FIG. 1; and, FIG. 3 is a view in vertical section, taken at line 3—3 on FIG. 1 and looking in the direction of the arrows, showing certain details of the honing member-doctor blade relationship during usage.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications of the illustrated device and such further applications of the principles of the invention as illustrated therein being contemplated as would normally occur to one skilled in the art to which the invention relates.

Referring now to the figures, the doctor blade sharpener of the invention is defined by a base plate 12 which may be of a length dictated by the size of the doctor blades to be sharpened. In this connection, and as a matter of example, from 7" to 68" long doctor blades might be involved. In any event, a main bar 14 on the base plate 12 mounts support brackets 15 proximate opposite ends thereof, such respectively receiving a rotatable drive sprocket 15*a* and a rotatable idler sprocket 15*b* onto which a link chain 15*c* is positioned for longitudinal reciprocating movement along the base plate 12 and over a doctor blade 10 under process. The idler end of the unit further includes a compression spring 16 operatively connecting to the axle shaft of the idler sprocket 15*b*.

Main bar 14 also positions brackets 17 which mount a longitudinally extending slide bar 19, the latter serving, among other purposes, to position limit switches 21*a* and 21*b* which form part of an air powered control arrangement. An air motor 21*c* (see FIG. 1), in an operative relationship with the rotatable drive sprocket 15*a*, powers the sharpener for automatic usage.

The link chain 15*c*, at its free ends, carries a sharpening stone assembly 25 which moves along the slide bar 19 on supports 25*a*. The sharpening stone assembly 25 mounts a honing stone 25*b* on a bracket 25*c* thereof, such being, for example, a commercially available fine grade India bench stone.

The doctor blade 10 being sharpened, secured to a doctor bar 10*a*, overlies the main bar 14 mounted on the base plate 12. Threaded means 10*b*, also disposed on the latter, serve to selectively move the doctor blade 10 into a sharpening relationship with the honing stone 25*b*. In any event, the doctor blade 10, a back-up blade 10', and the doctor bar 10*a* make up the doctor blade assembly. The preceding should be evident from the showing of FIG. 3.

In use, and upon operation of the air motor 21*c*, the sharpening stone assembly 25 automatically moves from right to left and from left to right (in FIG. 2), in consecutive passes, honing or sharpening the doctor blade 10 and avoiding direct physical contact by an operator during such sharpening procedure. In other words, when the sharpening stone assembly 25 reaches one end of the base plate 12 and engages a limit switch, as 21*a*, the operation of the air motor 21*c* is reversed, where, actually, a slight pause might be involved.

Thereafter, the sharpening stone assembly 25 travels towards the other end of the base plate 12, contacting limit switch 21*b*, again causing an opposite direction change. In other words, the reciprocating movement of the sharpening stone assembly 25 achieves sharpening or honing at a uniform rate and at a desired pressure.

As to the latter, adjustment of the threaded means 10*b* places the doctor blade 10 in any selected sharpening relationship with the sharpening stone assembly 25. In that the angle of the edge of the doctor blade 10 is typically 45°, the honing or sharpening action is accomplished at such 45° angle and, moreover, through regulation of air flow from the source (not shown) to the air motor 21*c*, the honing or sharpening speed can be varied.

As stated, the importance of the invention lies in automatically achieving sharpening or honing through an arrangement which prevents hand or body injury to the operator. The preceding is in contrast to the present use of a hand held knife sharpener employing, for example, a carbide wheel. Not only is safety achieved, but uniform sharpening or honing from one end of the doctor blade 10 to the other. Additionally, various size doctor blades 10 can be accommodated, the rate of honing or sharpening varied, as well as the angle of sharpening or honing. The preceding spells versatility for the invention.

The doctor blade sharpener described hereabove is susceptible to various changes within the spirit of the invention as, for example, the manner of controlling the movement of the sharpening stone assembly; the source of power for the movement of the sharpening stone assembly; the positioning of the doctor blade; and, the like. Thus, the preceding should be considered illustrative and not as limiting the scope of the following claims:

I claim:

1. A doctor blade sharpener comprising a base plate selectively receiving an elongated doctor blade for processing, said elongated doctor blade having a beveled longitudinal edge, a sharpening stone assembly supported on a slide bar mounted on said base plate above said elongated doctor blade, means for moving said stone assembly bi-directionally and progressively along the length of said beveled longitudinal edge of said elongated doctor doctor blade in a sharpening relationship independent of direct personal handling of said sharpening stone assembly during sharpening, and means selectively and threadedly urging said elongated doctor blade into said sharpening relationship with said sharpening stone assembly, said means for moving said stone assembly comprising sprocket members positioned on said base plate, a link chain mounted on said sprocket members, and the free ends of said link chain being connected to said sharpening stone assembly.

2. The doctor blade sharpener of claim 1 wherein said movement of said sharpening stone assembly is achieved by an air motor, and where limit switches control said bi-directional and progressive movement of said sharpening stone assembly.

* * * * *